US008203403B2

(12) United States Patent
Moeller et al.

(10) Patent No.: US 8,203,403 B2
(45) Date of Patent: Jun. 19, 2012

(54) ELECTRICAL SWITCHING DEVICES HAVING MOVEABLE TERMINALS

(75) Inventors: Matthew Len Moeller, Rock Falls, IL (US); Kurt Thomas Zarbock, Advance, NC (US); David Glen Parker, Trinity, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 189 days.

(21) Appl. No.: 12/549,176

(22) Filed: Aug. 27, 2009

(65) Prior Publication Data

US 2011/0048907 A1 Mar. 3, 2011

(51) Int. Cl.
*H01H 51/22* (2006.01)
*H01H 67/02* (2006.01)

(52) U.S. Cl. ..... 335/78; 335/129

(58) Field of Classification Search ..... 335/78
See application file for complete search history.

(56) References Cited

U.S. PATENT DOCUMENTS

| | | | | | |
|---|---|---|---|---|---|
| 3,484,729 | A | * | 12/1969 | Schuessler et al. | 335/200 |
| 3,965,450 | A | * | 6/1976 | Schilling | 335/63 |
| 3,993,971 | A | * | 11/1976 | Ono et al. | 335/202 |
| 4,388,535 | A | | 6/1983 | Wiktor et al. | |
| 4,430,579 | A | | 2/1984 | Wiktor | |
| 4,529,953 | A | | 7/1985 | Myers | |
| 4,562,418 | A | | 12/1985 | Bachler | |
| 4,625,191 | A | * | 11/1986 | Oberndorfer et al. | 335/78 |
| 5,359,305 | A | * | 10/1994 | Kitamura et al. | 335/78 |
| 5,568,108 | A | * | 10/1996 | Kirsch | 335/130 |
| 5,684,442 | A | | 11/1997 | Hufschmid | |
| 5,694,099 | A | | 12/1997 | Connell et al. | |
| 5,696,475 | A | * | 12/1997 | Yoshitani et al. | 335/78 |
| 5,719,541 | A | * | 2/1998 | Mader | 335/78 |
| 5,907,269 | A | * | 5/1999 | Zrostlik | 335/215 |
| 5,994,987 | A | * | 11/1999 | Passow | 335/78 |
| 6,020,801 | A | * | 2/2000 | Passow | 335/78 |
| 6,046,660 | A | | 4/2000 | Gruner | |
| 6,046,661 | A | * | 4/2000 | Reger et al. | 335/185 |
| 6,292,075 | B1 | | 9/2001 | Connell et al. | |

(Continued)

FOREIGN PATENT DOCUMENTS

| | | |
|---|---|---|
| EP | 1 681 699 | 7/2006 |

(Continued)

OTHER PUBLICATIONS

International Search Report, International Application No. PCT/US2010/002325, International Filing Date Aug. 24, 2010.

*Primary Examiner* — Lincoln Donovan
*Assistant Examiner* — Alexander Talpalatskiy

(57) ABSTRACT

An electrical switching device that includes first and second circuit assemblies. Each of the first and second circuit assemblies includes a base terminal and a moveable terminal that is configured to flex to and from the base terminal. The switching device also includes a coupling element that is operatively coupled to the moveable terminals of the first and second circuit assemblies. The switching device also includes an electromechanical motor that has a pivot body that is operatively coupled to the coupling element. The pivot body is configured to rotate bi-directionally about a center of rotation. The pivot body moves the coupling element side-to-side along a longitudinal axis so that the moveable terminals move in a common direction with respect to each other and along the longitudinal axis when the pivot body is rotated between first and second rotational positions.

20 Claims, 9 Drawing Sheets

U.S. PATENT DOCUMENTS

| | | | | |
|---|---|---|---|---|
| 6,320,485 | B1 | 11/2001 | Gruner | |
| 6,563,409 | B2 | 5/2003 | Gruner | |
| 6,621,393 | B2 | 9/2003 | Comtois et al. | |
| 6,628,184 | B1 | 9/2003 | Cassagrande et al. | |
| 6,661,319 | B2 * | 12/2003 | Schmelz | 335/78 |
| 6,788,176 | B2 * | 9/2004 | Schmelz | 335/80 |
| 6,816,353 | B2 | 11/2004 | Mani et al. | |
| 7,049,932 | B2 | 5/2006 | French et al. | |
| 2009/0033446 | A1 | 2/2009 | Gruner et al. | |
| 2009/0033447 | A1 | 2/2009 | Gruner et al. | |

FOREIGN PATENT DOCUMENTS

| | | |
|---|---|---|
| EP | 1843377 | 1/2007 |
| EP | 1968083 | 6/2007 |
| EP | 2 009 665 | 12/2008 |
| JP | 2004 139750 | 5/2004 |
| WO | WO 03/049129 | 6/2003 |
| WO | WO 2005/106907 | 11/2005 |
| WO | WO 2006/024855 | 3/2006 |
| WO | WO 2006/035235 | 4/2006 |
| WO | WO 2007/012883 | 2/2007 |

* cited by examiner

ELECTRICAL SWITCHING DEVICES HAVING MOVEABLE TERMINALS

BACKGROUND OF THE INVENTION

The invention relates generally to electrical switching devices that are configured to control the flow of an electrical current therethrough, and more particularly, to switching devices that control an amount of power that is supplied to an electrical device or system.

Electrical switching devices (e.g., contactors, relays) exist today for connecting or disconnecting a power supply to an electrical device or system. For example, an electrical switching device may be used in an electrical meter that monitors power usage by a home or building. Conventional electrical devices include a housing that receives a plurality of input and output terminals and a mechanism for electrically connecting the input and output terminals. In some switching devices, a solenoid actuator is operatively coupled to mating contact(s) of one of the terminals. When the solenoid actuator is triggered or activated, the solenoid actuator generates a predetermined magnetic field that is configured to move the mating contact(s) toward other mating contact(s) to establish an electrical connection. The solenoid actuator may also be activated to generate an opposite magnetic field to disconnect the mating contacts.

However, a switching device that uses a solenoid actuator as described above may include several components and interconnected parts within the housing. This, in turn, may lead to greater costs and time spent to assemble the switching devices. Another problem confronted by the manufacturers of the switching devices is the heat generated by the current-carrying components. Because conventional switching devices include housings with confined spaces, the switching devices known today have limited capabilities for controlling the generated heat. If the heat becomes excessive, other parts and circuits within the switching device may be damaged or negatively affected.

Accordingly, there is a need for electrical switching devices that may reduce the number of components and simplify the assembling as compared to known switching devices. There is also a need for switching devices that are configured to control the temperature rises within housings of the switching devices.

BRIEF DESCRIPTION OF THE INVENTION

In accordance with one embodiment, an electrical switching device is provided that includes first and second circuit assemblies. Each of the first and second circuit assemblies includes a base terminal and a moveable terminal that is configured to flex to and from the base terminal. The switching device also includes a coupling element that is operatively coupled to the moveable terminals of the first and second circuit assemblies. The switching device also includes an electromechanical motor that has a pivot body that is operatively coupled to the coupling element. The pivot body is configured to rotate bi-directionally about a center of rotation. The pivot body moves the coupling element side-to-side along a longitudinal axis so that the moveable terminals move in a common direction with respect to each other and along the longitudinal axis when the pivot body is rotated between first and second rotational positions. The moveable terminals are electrically connected to the corresponding base terminals when the pivot body is in the first rotational position and disconnected from the corresponding base terminals when the pivot body is in the second rotational position.

In accordance with another embodiment, an electrical switching device is provided that includes first and second circuit assemblies. Each of the first and second circuit assemblies has a base terminal and a moveable terminal that is configured to flex to and from the base terminal. The moveable terminals of the first and second circuit assemblies extend substantially parallel to one another and have a spacing therebetween. The switching device also includes a coupling element that extends lengthwise across the spacing and is operatively coupled to the moveable terminals. The switching device also includes an electromechanical motor that has a pivot body that is operatively coupled to and located proximate to the coupling element. The pivot body rotates bi-directionally about a center of rotation between first and second rotational positions so that the coupling element moves side-to-side along a longitudinal axis within the spacing. The moveable terminals are electrically connected to the corresponding base terminals when the pivot body is in the first rotational position and disconnected from the corresponding base terminals when the pivot body is in the second rotational position.

DETAILED DESCRIPTION OF THE INVENTION

Figure 1:
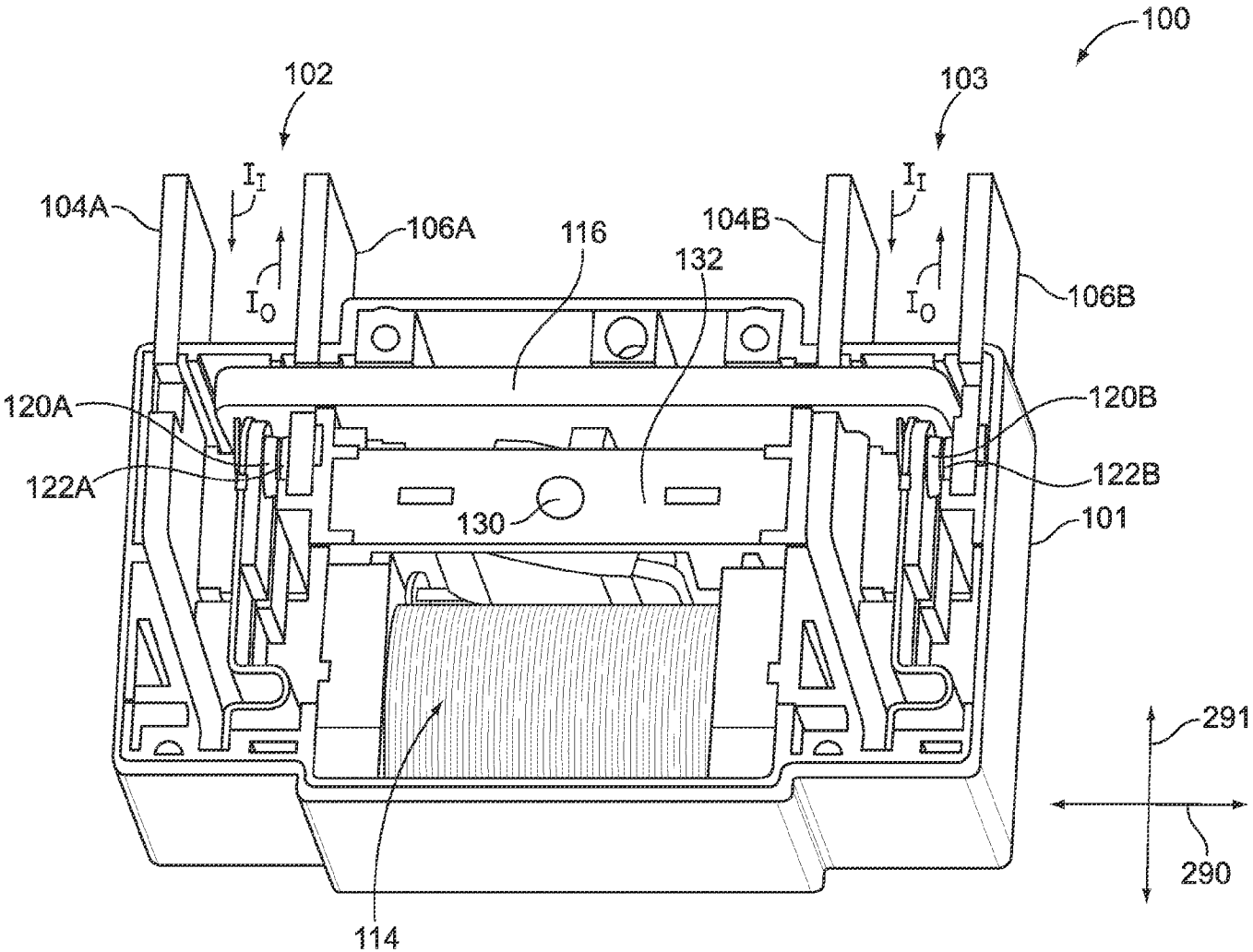
FIG. 1 is an exposed perspective view of an electrical switching device formed in accordance with one embodiment.

FIG. 1 is an exposed perspective view of an electrical switching device 100 formed in accordance with one embodiment. The switching device 100 includes a switch housing 101 that is configured to receive and enclose at least one circuit assembly (shown as a pair of circuit assemblies 102 and 103). The circuit assemblies 102 and 103 may also be referred to as poles. (In FIG. 1, a cover of the switch housing 101 has been removed to reveal internal components of the switching device 100.) The circuit assembly 102 includes terminals 104A and 106A, and the circuit assembly 103 includes terminals 104B and 106B. The terminals 104 and 106 may all be received into the switch housing 101 through a common side. However, in alternative embodiments, the terminals 104A, 104B, 106A, and 106B may enter through different sides. For example, the terminals 104A and 104B may enter through one side and the terminals 106A and 106B may enter through another side.

The terminals 104A and 106A electrically connect to each other within the switch housing 101 through mating contacts 120A and 122A, and the terminals 104B and 106B electrically connect to each other within the switch housing 101 through mating contacts 120B and 122B. The terminals 104A and 104B are input terminals that receive an electrical current $I_I$ from a remote power supply, and the terminals 106A and 106B are output terminals configured to deliver the current $I_O$ to an electrical device or system. In the exemplary embodiment, the terminals 106A and 106B may be referred to as base terminals, and the terminals 104A and 104B may be referred to as moveable terminals since the terminals 104A and 104B may be moved to and from the terminals 106A and 106B, respectively. However, in other embodiments, the terminals 104A and/or 104B may be base terminals and the terminals 106A and/or 106B may be moveable terminals. As shown, the terminals 104A and 106A and the corresponding mating contacts 120A and 122A may form the circuit assembly 102. Likewise, the terminals 104B and 106B and the corresponding mating contacts 120B and 122B may form the circuit assembly 103.

The switching device 100 is configured to selectively control the flow of current through the switch housing 101. By way of one example, the switching device 100 may be used with an electrical meter of an electrical system for a home or building. Current enters the switch housing 101 through the terminals 104A and 104B and exits the switch housing 101 through the terminals 106A and 106B. In some embodiments, the switching device 100 is configured to simultaneously connect or disconnect the mating contacts 120A and 122A and the mating contacts 120B and 122B.

As shown, the switching device 100 is oriented with respect to a longitudinal axis 290 and a vertical axis 291. The switching device 100 may include the circuit assemblies 102 and 103, an electromechanical motor 114, and a coupling element 116 that cooperate with each other in opening and closing the circuits formed by the terminals. The switching device 100 may include an auxiliary switch (not shown) that is actuated by the pivot assembly 130. The auxiliary switch may provide status information or other data regarding the switching device 100 to an electrical system (e.g., electrical meter or remote system). The motor 114 includes a pivot assembly 130 that is operatively coupled or connected to the coupling element 116. The coupling element 116, in turn, is operatively coupled to the circuit assemblies 102 and 103. Also shown, the pivot assembly 130 includes a pivot stabilizer 132 that supports a pivot body 160 (shown in FIG. 2) when the pivot body 160 is rotated.

In some embodiments, the switching device is communicatively coupled to a remote controller (not shown). The remote controller may communicate instructions to the switching device 100. The instructions may include operating commands for activating or inactivating the motor 114. In addition, the instructions may include requests for data regarding usage or a status of the switching device 100 or usage of electricity.

Figure 2:
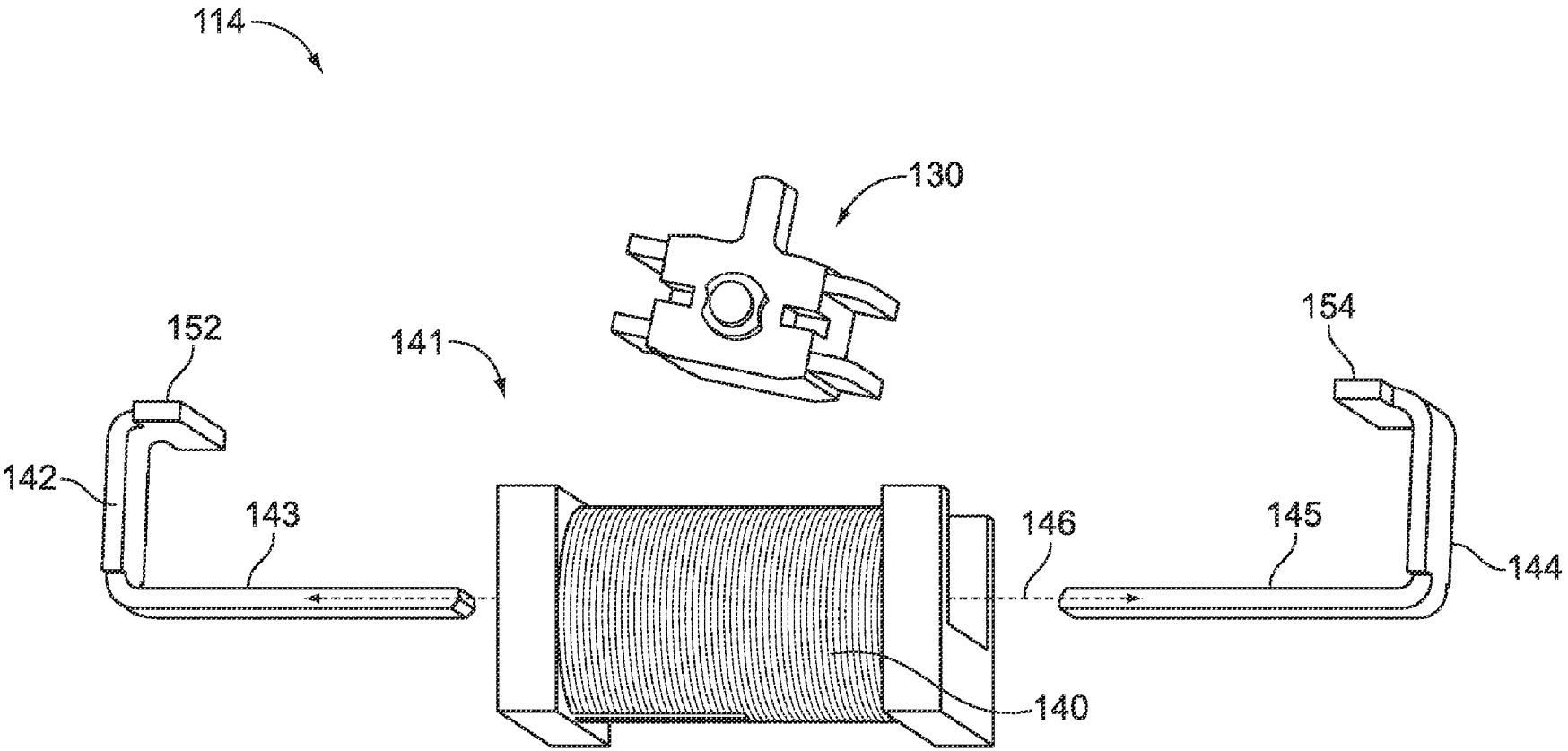
FIG. 2 is an exploded view of an electromechanical motor that may be used with the switching device of FIG. 1.

FIG. 2 is an exploded view of the motor 114. In the exemplary embodiment, the motor 114 generates a predetermined magnetic flux or field to control the movement of the coupling element 116 (FIG. 1). For example, the motor 114 may be a solenoid actuator. More specifically, the motor 114 may include the pivot assembly 130 and a coil assembly 141. The coil assembly 141 includes an electromagnetic coil 140 and a pair of yokes 142 and 144. The coil 140 extends along a coil axis 146. The yokes 142 and 144 include legs 143 an 145, respectively, that are inserted into a cavity (not shown) of the coil 140 and extend along the coil axis 146. The yokes 142 and 144 include yoke ends 152 and 154 that are configured to magnetically couple to the pivot assembly 130 to control rotation of the pivot assembly 130. When the coil 140 is activated, a magnetic field is generated that extends through the coil assembly 141 and the pivot assembly 130. In the exemplary embodiment, the magnetic field has a looping shape. A direction of the field is dependent upon the direction of the current flowing through the coil 140. Based upon the direction of the current, the pivot assembly 130 will move to one of two rotational positions.

Figure 3:
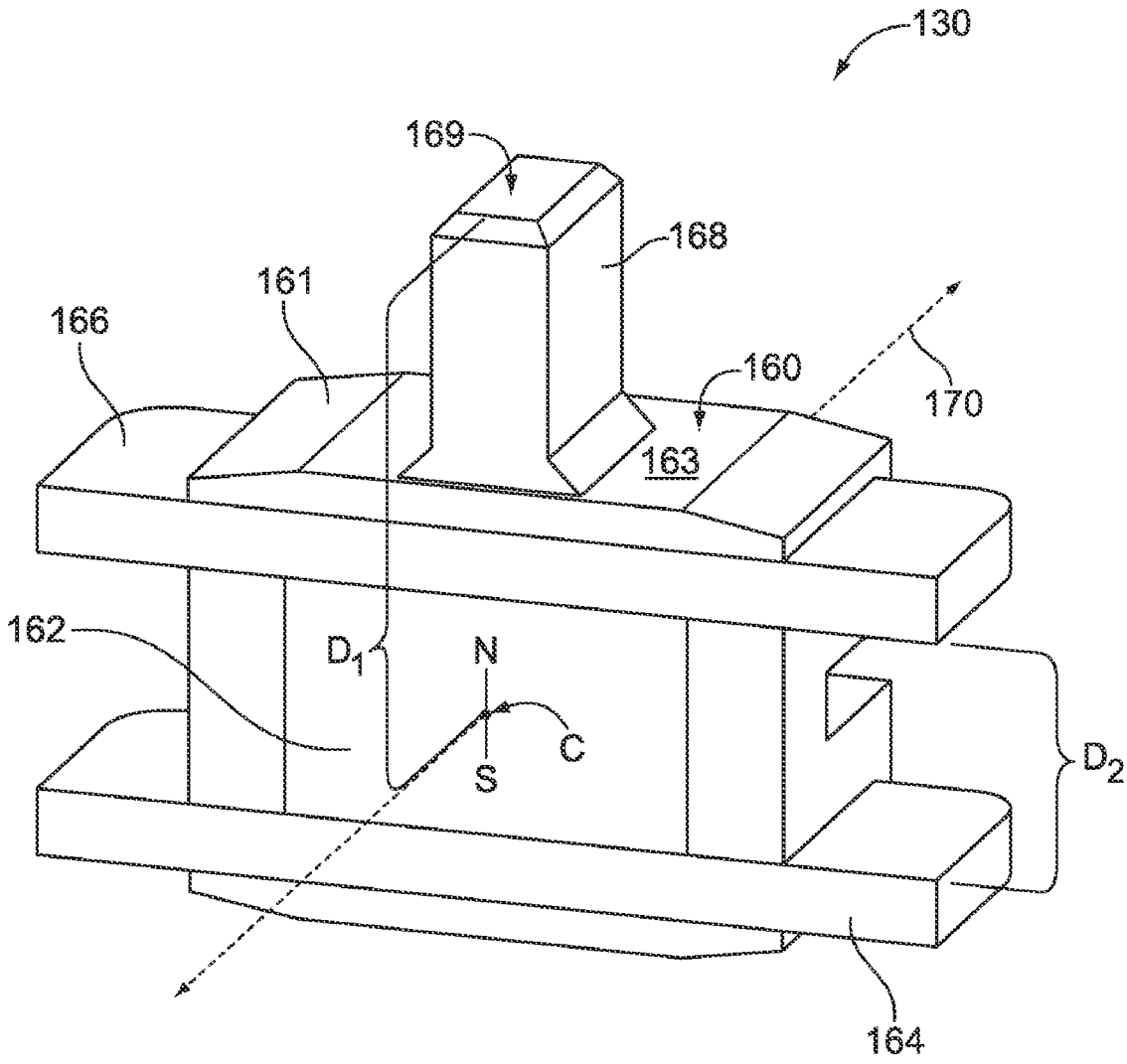
FIG. 3 is a cross-sectional view of a pivot body that may be used with the switching device of FIG. 1.

As shown in FIG. 3, the pivot assembly 130 includes a pivot body 160 having a casing 161 that holds a permanent magnet 162 and a pair of armatures 164 and 166. As shown, the magnet 162 has opposite North and South poles or ends that are each positioned proximate to a corresponding one armature 166 and 164, respectively. The armatures 164 and 166 may be positioned with respect to each other and the magnet 162 to form a predetermined magnetic flux for selectively rotating the pivot assembly 130. For example, the armatures 164 and 166 may abut the magnet 162 at the South and North poles, respectively, and extend substantially parallel to one another and in directions that are substantially perpendicular to the magnetic dipole moment (indicated as a line extending between the North and South poles). The armatures may be a substantially uniform distance $D_2$ apart from one another. As such, the arrangement of the armatures 164 and 166 and the magnet 162 may be substantially H-shaped. However, other arrangements of the armatures 164 and 166 and the magnet 162 may be made.

Also shown, the casing 161 includes a projection or post 168 that projects away from an exterior surface 163 of the pivot body 160 (or casing 161). For example, the post 168 may extend to a distal end 169 that is located a distance $D_1$ away from a center of rotation C of the pivot body 160. In a particular embodiment, the post 168 may extend along a radial line that extends from the center of rotation C of the pivot body 160 to the distal end 169. However, in alternative embodiments, the post 168 is not required to extend along a radial line away from the center of rotation C. The pivot assembly 130 may rotate about a pivot axis 170 that extends through the center of rotation C.

Figure 4:
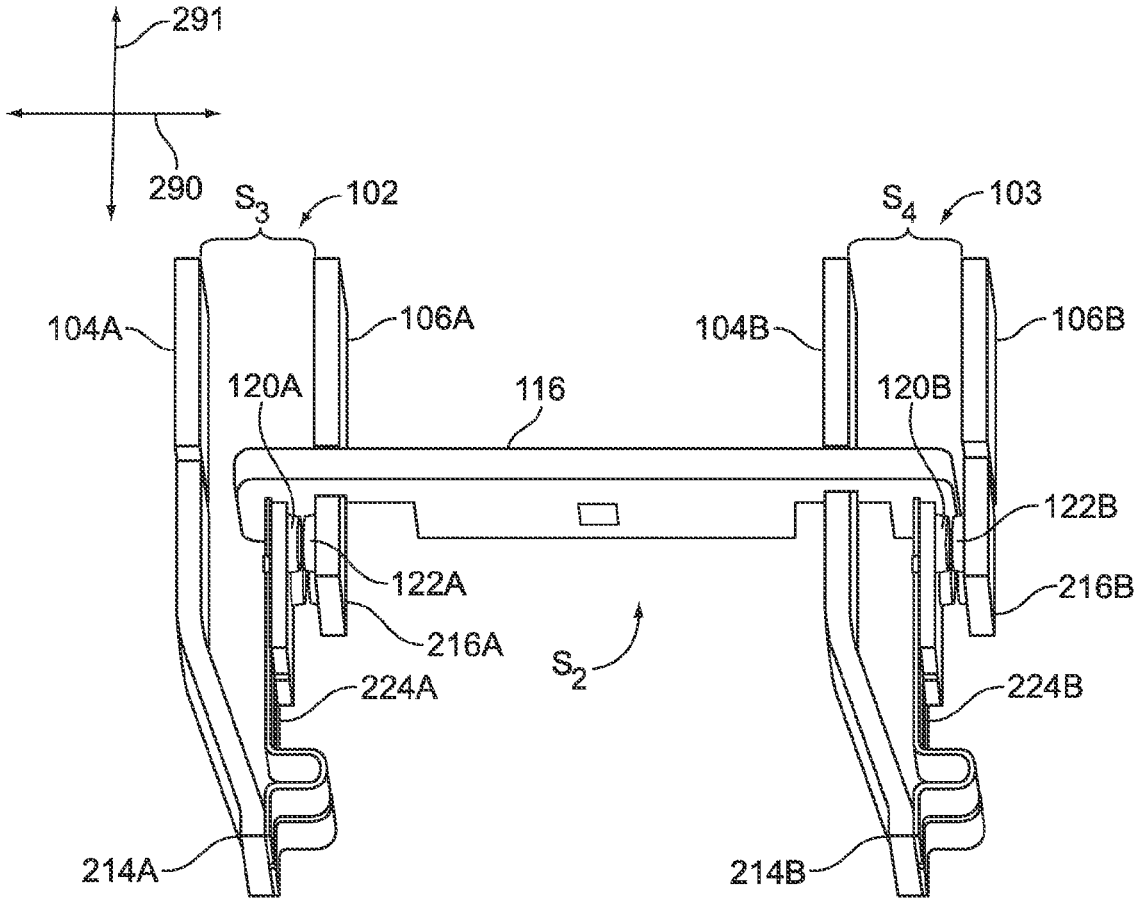
FIG. 4 is a perspective view of a coupling element operatively coupled to circuit assemblies of the switching device shown in FIG. 1.

FIG. 4 is an isolated perspective view of the circuit assemblies 102 and 103 operatively coupled to the coupling element 116. As shown in FIG. 4, the terminals 104A and 106A extend substantially parallel to one another along the vertical axis 291 and have a spacing $S_3$ therebetween. The terminals 104B and 106B may extend substantially parallel to one another also along the vertical axis 291 and have a spacing $S_4$ therebetween. Furthermore, the coupling element 116 may extend between the circuit assemblies 102 and 103 along the longitudinal axis 290. More specifically, the circuit assemblies 102 and 103 are separated by a spacing $S_2$. In the exemplary embodiment, the coupling element 116 extends across the spacing $S_2$ and operatively couples to the terminals 104A and 106A. With reference to FIG. 1, the motor 114 may be located between the terminals 104A and 106A.

Each of the terminals 104 and 106 extend to corresponding end portions 214 and 216, respectively. In the exemplary embodiment, the terminals 104A and 104B may include spring blades 224A and 224B, respectively, that extend from the end portions 214A and 214B, respectively, toward the corresponding terminal 106. The spring blade 224A may extend into the spacing $S_3$ that separates the terminals 104A and 106A and be operatively coupled to the coupling element 116 therebetween. The spring blade 224B may extend into the spacing $S_4$ that separates the terminals 104B and 106B therebetween and be operatively coupled to the coupling element 116 therebetween. As shown, the spring blades 224A and 224B include the mating contacts 120A and 120B, respectively, and the end portions 216A and 216B include the mating contacts 122A and 122B, respectively. The spring blades 224 are moveable such that the mating contacts 120 may be moved to and from the corresponding mating contacts 122 to electrically connect and disconnect the mating contacts 120 and 122.

FIG. 4 illustrates the spring blades 224A and 224B in a substantially relaxed (i.e., unflexed) positions. In the exemplary embodiment, the mating contacts 120 and 122 are electrically connected with one another when the spring blades 224 are in the relaxed positions such that current flows therethrough. In alternative embodiments, the mating contacts 120 and 122 may be separated by a spacing when the spring blades 224A and 224B are in the relaxed positions such that the mating contacts 120 and 122 are disconnected and current does not flow therethrough.

Figure 5:
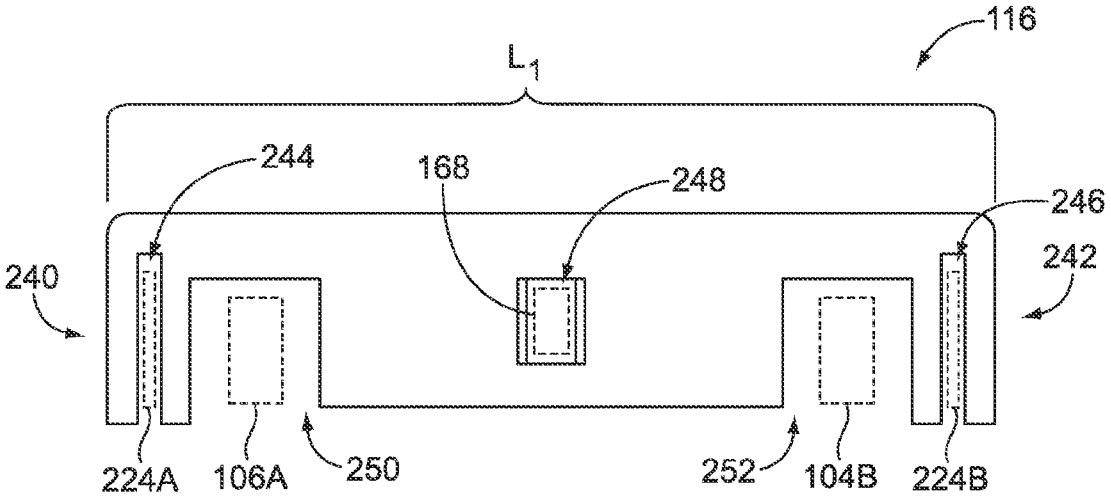
FIG. 5 is a plan view of the coupling element shown in FIG. 4.

FIG. 5 is an isolated bottom view of the coupling element 116. The coupling element 116 extends a length $L_1$ between opposite ends 240 and 242. The coupling element 116 may have a substantially planar body and include slots 244 and 246 configured to receive the spring blades 224A and 224B, respectively. (Cross-sections of the spring blades 224A and 224B are indicated by dashed lines.) The coupling element 116 may also include an opening 248 that is configured to receive the distal end 169 (FIG. 2) of the post 168 (cross-section indicated by dashed lines). The opening 248 may be located between the slots 244 and 246. The opening 248 may be sized and shaped to be greater than a cross-section of the post 168 to allow some movement within the opening 248 without moving the coupling element 116. In addition, the coupling element 116 may also include recesses 250 and 252. The recess 250 may be located between the slot 244 and the opening 248, and the recess 252 may be located between the slot 246 and the opening 248. The recesses 250 and 252 may be sized and shaped to allow at least one of the terminals 104 and/or 106 to pass therethrough when the switching device 100 (FIG. 1) is fully assembled. In the exemplary embodiment, the recesses 250 and 252 are sized and shaped to allow the terminals 106A and 104B, respectively, to pass therethrough. Furthermore, the recesses 250 and 252 may be sized and shaped to allow the coupling element 116 to be moved back and forth in different axial positions while the terminal (s) extends through the recess in a stationary position. As shown, the terminals 106A and 104B may extend substantially perpendicular to the direction in which the coupling element 116 moves.

In alternative embodiments, the coupling element 116 may include only one slot or more than two slots. Likewise, in alternative embodiments, the coupling element 116 may include only one recess or more than two recesses. Furthermore, the stationary terminals 106A and 104B may extend around the coupling element 116 in alternative embodiments instead of extending through the coupling element 116.

Figure 6:
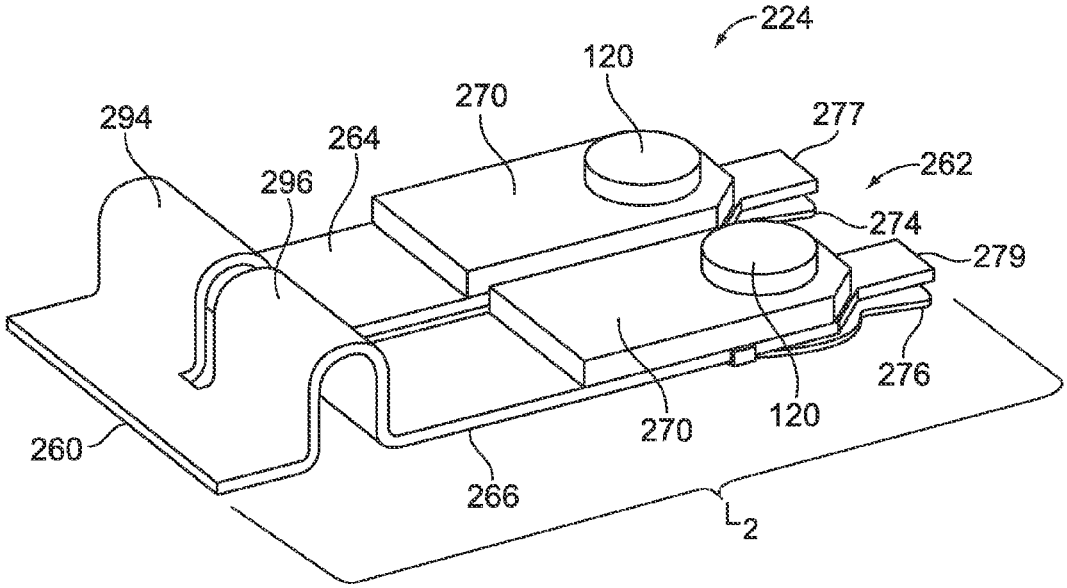
FIG. 6 is a perspective view of a spring blade that may be used with the switching device of FIG. 1.

FIG. 6 is a perspective view of the spring blade 224. The spring blade 224 has a length $L_2$ that extends between two blade ends 260 and 262. The spring blade 224 also has bifurcated paths 264 and 266 with a spacing therebetween. The bifurcated paths 264 and 266 are joined together at the blade ends 260. The bifurcated paths 264 and 266 are not joined together at the blade end 262, but instead extend to separate tabs 277 and 279, respectively. As shown, the spring blade 224 also includes a heat sink 270 and the mating contact 120 coupled to the bifurcated paths 264 and 266. The heat sinks 270 may be welded to the corresponding bifurcated path. The heat sink 270 may be in direct contact with the mating contact 120. For example, the heat sink 270 may directly surround the mating contact 120 or may have the mating contact 120 directly attached thereon. The heat sinks 270 are configured to facilitate distributing the heat generated by the current flowing through the spring blade 224 and the contact 120. As shown, the heat sinks 270 may extend lengthwise along the bifurcated paths 264 and 266.

Each bifurcated path 264 and 266 may form flex regions 294 and 296. The flex regions 294 and 296 may be U-shaped and configured to facilitate moving the spring blade 224 to and from the mating contacts 122 (FIG. 1) of the terminals 106 (FIG. 1) when the coupling element 116 (FIG. 1) is moved. The coupling element 116 grips the tabs 277 and 279 (i.e. the tabs 277 and 279 may be inserted into one of the slots 244 or 246 (FIG. 5)). The end 260 may be attached to the end portion 214 (FIG. 4) of the terminal 104 (FIG. 1). Also shown, the spring blade 224 may include spring clips or fingers 274 and 276 that project alongside the bifurcated paths 264 and 266, respectively. The spring fingers 274 and 276 may be fastened or formed with the bifurcated paths 264 and 266, respectively, and located proximate to the blade end 262 or tabs 277 and 279. The spring fingers 274 and 276 may be inserted into one of the slots 244 or 246 along with the tabs 277 and 279, respectively. As one example, the spring blade 224 may be configured to transmit 200A in which 100A flows through each bifurcated path 264 and 266. In the exemplary embodiment, the spring blades 224A and 224B have substantially equal lengths $L_2$.

Figure 7:
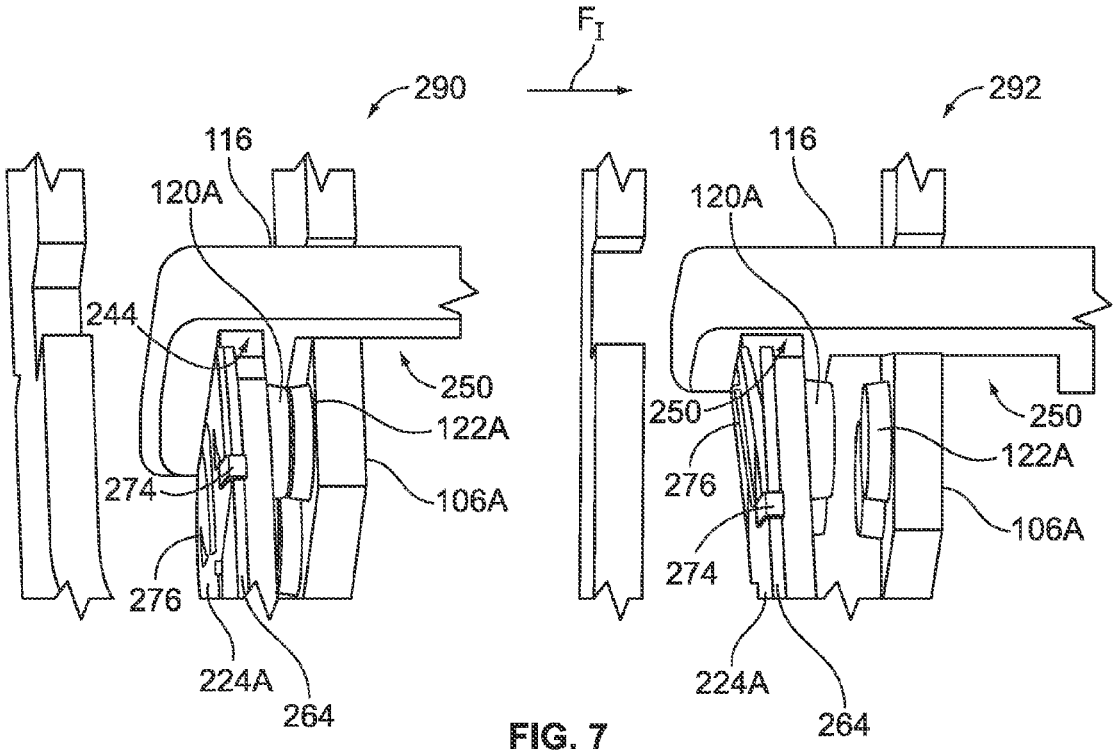
FIG. 7 illustrates the spring blade of FIG. 8 in relaxed and flexed positions.

FIG. 7 is an enlarged view of the spring blade 224A in a relaxed position 290 and in a flexed position 292. The coupling element 116 receives the ends 262 (FIG. 6) of the spring blade 224A in a corresponding slot 250. In particular, the spring fingers 274 and 276 and the tabs 277 and 279 are received within the slot 250. When the spring blade 224A is in the relaxed position 290 (i.e., when the bifurcated paths 264 and 266 (FIG. 6) are relaxed), the spring fingers 274 and 276 may be compressed toward the bifurcated paths 264 and 266. When the spring blade 224A is in the flexed position 292, the spring fingers 274 and 276 are flexed outward such that there is a spacing between the spring fingers 274 and 276 and the corresponding tabs 277 and 279. As such, the spring fingers 274 and 276 may be in relaxed positions when the spring blade 224A is in the flexed position 292 and may be in a flexed or compressed position when the spring blade 224A is in the relaxed position 290.

The spring fingers 274 and 276 may facilitate maintaining the connection between the mating contacts 120A and 122A by providing a force against the coupling element 116 to push the spring blade 224A toward the base terminal 106A. Furthermore, through time, the mating contacts 120A and 122A may become worn and the material forming the mating contacts 120A and 122A may reduce or be worn away. In such cases, the spring fingers 274 and 276 may also facilitate maintaining the connection of the mating contacts 120A and 122A. More specifically, the spring fingers 274 and 276 push against a sidewall (not shown) of the slot 250 thereby providing an inward force $F_I$ that pushes the mating contact 120A toward the mating contact 122A. As the material of the mating contact 120A is worn away, the spring fingers 274 and 276 may still maintain the connection by moving the mating contact 120A toward the mating contact 122A so that the two mating contacts remain connected.

Figure 8:
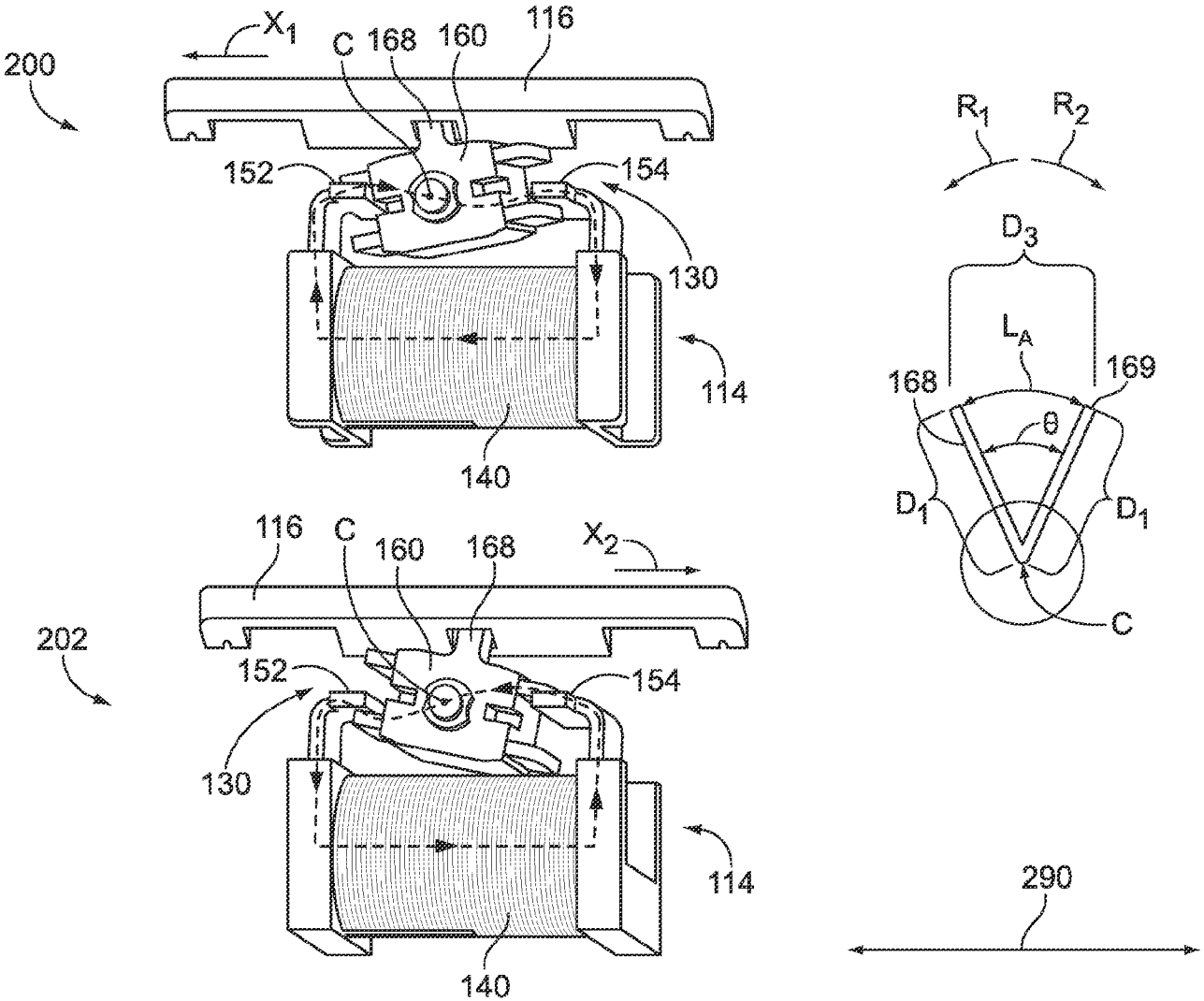
FIG. 8 illustrates movement of a coupling element when the pivot body of FIG. 3 is rotated between different positions.

FIG. 8 illustrates movement of the coupling element 116 when the pivot assembly 130 is rotated between a first rotational position 200 and a second rotational position 202. By way of example, when the motor 114 receives a positive signal, the pivot body 160 may rotate about the center of rotation C or the pivot axis 170 (FIG. 3)) in a direction $R_1$ (shown as counter-clockwise in FIG. 8) until the pivot body 160 reaches the rotational position 200. The post 168 moves (i.e., translates) the coupling element 116 in a linear manner in a direction along a longitudinal axis 290. More specifically, the coupling element moves in an axial direction $X_1$.

As a specific example, the coil 140 may generate a predetermined magnetic field through the yoke ends 152 and 154 and the armatures 164 and 166 (FIG. 2) (as indicated by the arrows). After the pivot body 160 has reached the rotational position 200, the positive signal may be deactivated. With the coil 140 deactivated, the permanent magnet 162 (FIG. 3) may then maintain the rotational position 200 through magnetic coupling. The magnet 162 may maintain a magnetic field that extends through the armatures 164 and 166 and the yokes 142 and 144 (FIG. 2) as indicated by the arrows.

Furthermore, when the motor 114 receives a negative signal, the coil 140 may be activated to generate an opposite magnetic field through the yoke ends 152 and 154 and the armatures 164 and 166 (as indicated by the arrows). The pivot body 160 may then rotate in a direction $R_2$ (shown as clockwise in FIG. 8) about the center of rotation C until the pivot body 160 reaches the rotational position 202. As shown, the post 168 moves the coupling element 116 in an axial direction $X_2$ that is opposite the axial direction $X_1$.

After the pivot body 160 has reached the rotational position 202, the negative signal may be deactivated. Again, with the coil 140 deactivated, the magnet 162 may then maintain the rotational position 202 through magnetic coupling. Thus, the pivot body 160 may be moved between rotational positions 200 and 202 by rotating bi-directionally about the center of rotation C thereby moving the coupling element 116 bi-directionally in a linear manner along the longitudinal axis 290 between different axial positions. Accordingly, the rotational motion created by the pivot assembly 130 may be translated into linear motion along the longitudinal axis 290 for moving the spring blades 224A and 224B (FIG. 4).

As schematically shown in FIG. 8, the distal end 169 of post 168 moves an arc length $L_A$ about the center of rotation C. As such, the distal end 169 may move an axial distance $D_3$ along the longitudinal axis 290. The axial distance $D_3$ may be substantially equal to the axial distance moved by the coupling element 116. The axial distance $D_3$ may be determined by the distance $D_1$ that the post 168 extends from the center of rotation C and the arc length $L_A$ or an angle θ in which the post 168 is rotated. As one example, the post 168 may rotate approximately 30° about the center of rotation C. The coupling element 116 may be located proximate to the pivot body 160. More specifically, as shown in FIG. 8, the coupling element 116 may be located immediately adjacent to the pivot body 160, but provide enough room between the two to allow rotation of the pivot body 160.

With respect to FIGS. 4 and 5, in the exemplary embodiment, the end 240 (FIG. 5) and the slot 244 (FIG. 5) of the coupling element 116 are positioned within the spacing $S_3$ (FIG. 4) and the end 242 (FIG. 5) and the slot 246 (FIG. 5) are positioned within the spacing $S_4$ (FIG. 4). The base terminal 106A (FIG. 4) extends through the recess 250 (FIG. 5), and the moveable terminal 104B extends through the recess 252 (FIG. 5). When the coupling element 116 is moved side-to-side in the direction along the longitudinal axis 290, the ends 240 and 242 are moved within the respective spacings $S_3$ and $S_4$ and the base and moveable terminals 106A and 104B are moved within the respective recesses 250 and 252.

Figure 9:
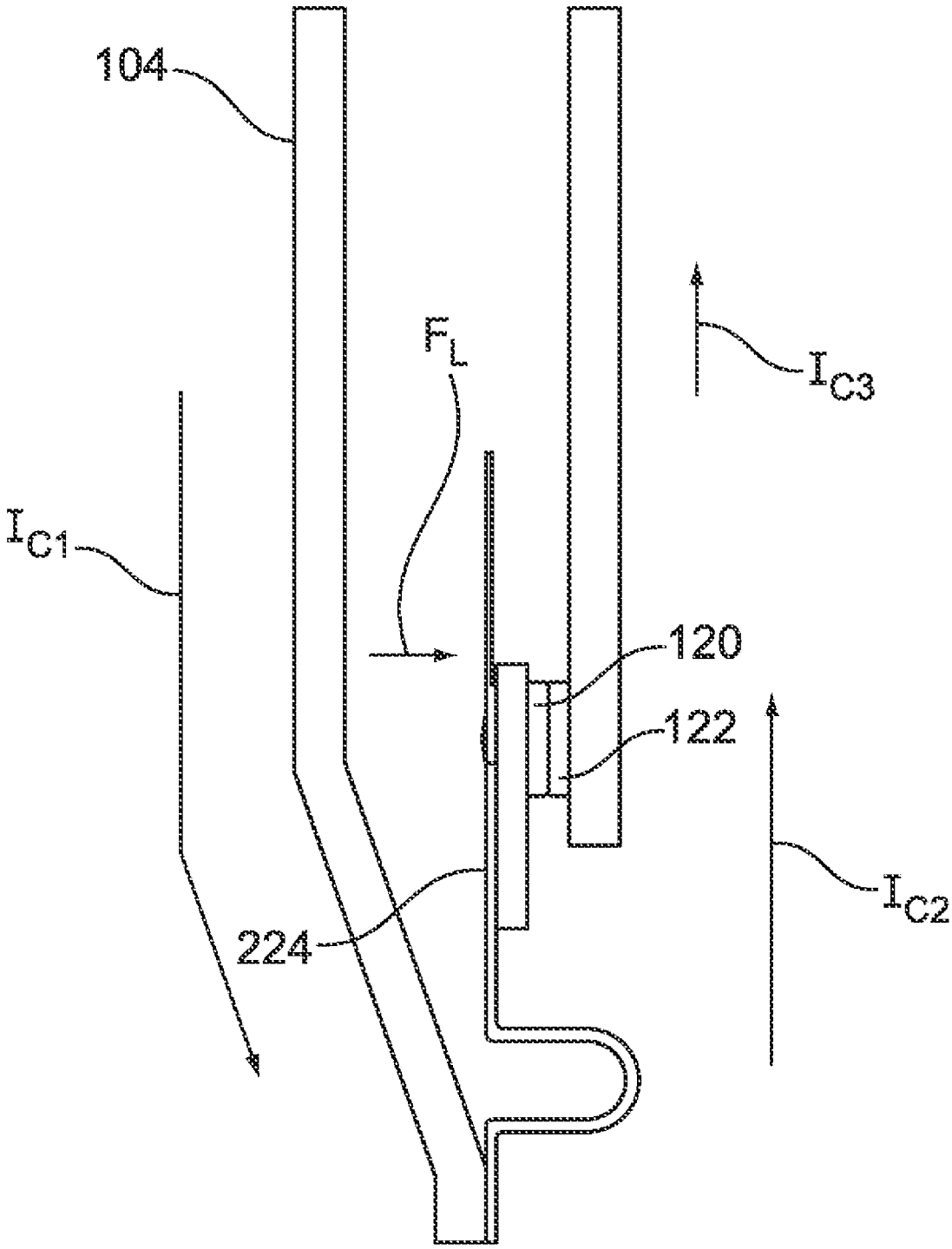
FIG. 9 is a plan view of current flowing through one circuit assembly of the switching device shown in FIG. 1.

FIG. 9 is a plan view of current flowing through the circuit assembly (e.g., circuit assemblies 102 or 103) of the switching device 100 shown in FIG. 1. In the exemplary embodiment, the terminal 104 and the corresponding spring blade 224 are configured to utilize Lorentz forces (also called Ampere's forces) to facilitate maintaining the connection between the mating contacts 120 and 122. More specifically, the terminals 104 and the spring blade 224 are arranged with respect to each other such that the current $I_{C1}$ extending through the terminal 104 is flowing in an opposite direction with respect to the current $I_{C2}$ flowing through the spring blade 224. As such, magnetic fields generated by the terminal 104 and the spring blade 224 force the spring blade 224 away from the terminal 104 and push the spring blade 224 toward the terminal 106. The Lorentz force, indicated as $F_L$, may facilitate maintaining the electrical connection between the mating contacts 120 and 122 during a high current fault.

Figure 10:
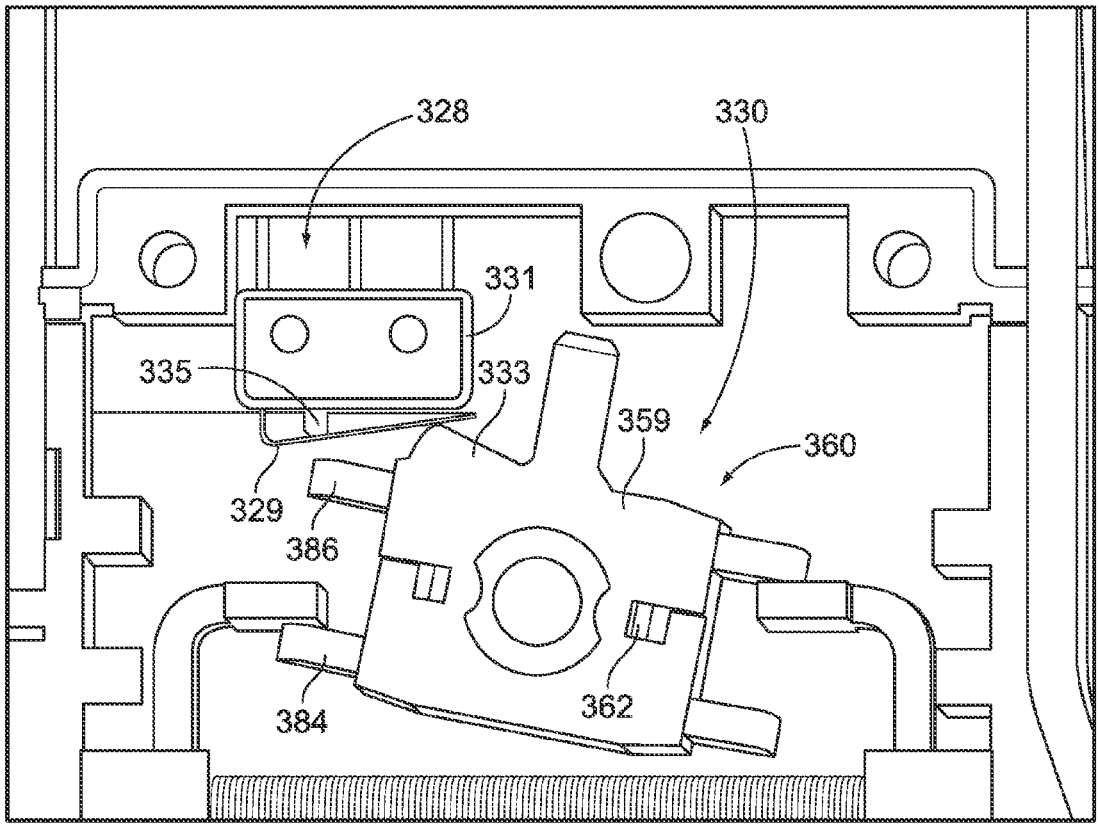
FIG. 10 is a perspective view of a pivot assembly that may be used with a switching device formed in accordance with another embodiment.
Figure 11:
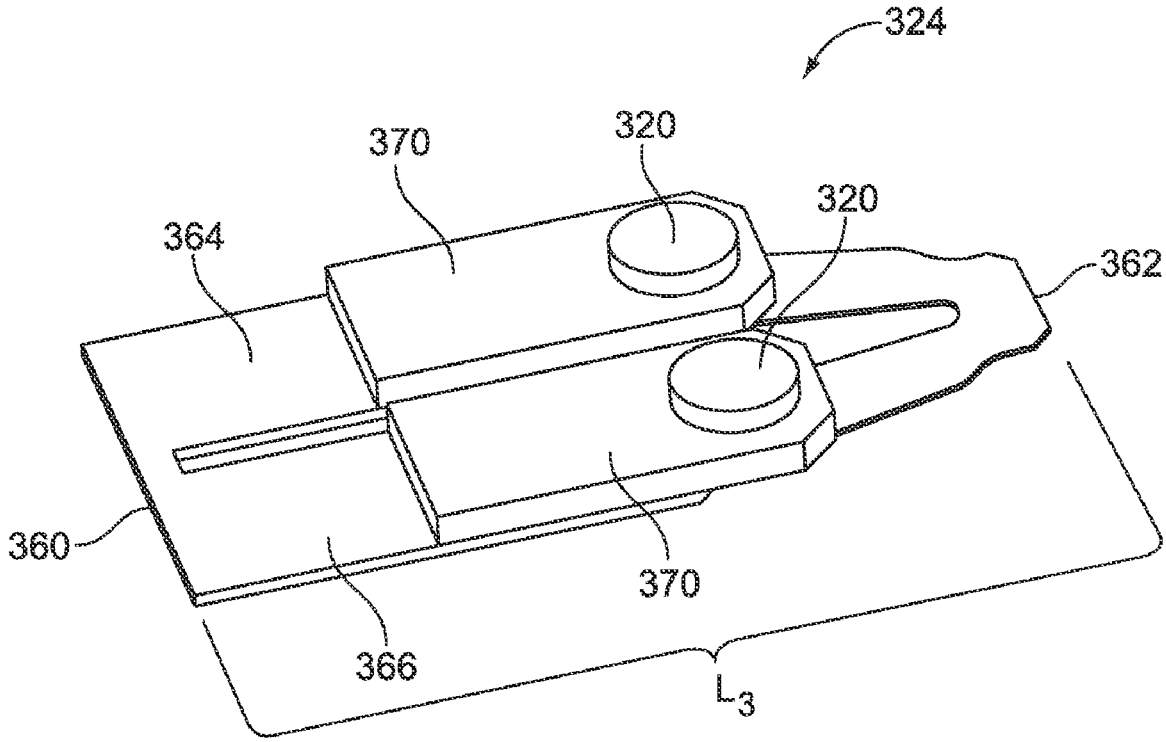
FIG. 11 is a perspective view of a spring blade formed in accordance with another embodiment that may be used with the circuit assembly of FIG. 9.

FIGS. 10 and 11 illustrate components of a switching device (not shown) formed in accordance with another embodiment. FIG. 10 is a perspective view of a pivot assembly 330 configured to interact with an auxiliary switch 328. The pivot assembly 330 may have similar components as the pivot assembly 130 (FIG. 1). The pivot assembly 330 may include a pivot body 360 having a casing 359 that holds a permanent magnet 362 and a pair of armatures 384 and 386. Similar to the magnet 162, the magnet 362 may have opposite North and South poles or ends that are each positioned proximate to a corresponding one armature 386 and 384, respectively. The pivot assembly 330 is configured to operate in a similar manner as described above with respect to the pivot assembly 130.

Also shown, the auxiliary switch 328 may include a switch body 331 having a flexible flange 329 and an auxiliary actuator 335. The flange 329 is configured to flex to and from the switch body 331 when moved by the casing 359 of the pivot body 360. When the flange 329 is moved toward the switch body 331, the flange 329 pushes the actuator 335 into the switch body 331 thereby activating/deactivaing the auxiliary switch 328. To this end, the casing 359 may include a protrusion 333 that extends away from the pivot body 360 and toward the auxiliary switch 328. The protrusion 333 may be operatively shaped to move the flange 329 to and from the switch body 331.

FIG. 11 is a perspective view of the spring blade 324. The spring blade 324 has a length $L_3$ that extends between two blade ends 360 and 362. The spring blade 324 also has bifurcated paths 364 and 366 with a spacing therebetween. The bifurcated paths 364 and 366 are joined together at the blade ends 360 and 362. As shown, each bifurcated path 364 and 366 includes a heat sink 370 and the mating contact 320. The heat sinks 370 may be welded to the corresponding bifurcated path. The heat sinks 370 may have similar features as the heat sinks 270 and may be configured to facilitate distributing the heat generated by the current flowing through the spring blade 324 and the contact 320. The spring blade 324 (and bifurcated paths 364 and 366) may be sized and shaped to flex resiliently to facilitate moving the spring blade 324 to move the mating contacts 320.

It is to be understood that the above description is intended to be illustrative, and not restrictive. For example, the terminal 104 may enter the switch housing 101 through one side of the switch housing 101, and the terminals 106 may enter the switch housing 101 through a different side.

Furthermore, the above-described embodiments (and/or aspects thereof) may be used in combination with each other. In addition, many modifications may be made to adapt a particular situation or material to the teachings of the invention without departing from its scope. While the specific components and processes described herein are intended to define the parameters of the various embodiments of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical switching device comprising:

first and second circuit assemblies, each of the first and second circuit assemblies comprising a base terminal and a moveable terminal configured to flex to and from the base terminal, wherein a spacing exists between the first and second circuit assemblies;

a coupling element being operatively coupled to the moveable terminals of the first and second circuit assemblies, the coupling element extending lengthwise across the spacing between the first and second circuit assemblies; and an electromechanical motor including a pivot body operatively coupled to the coupling element and configured to rotate bi-directionally about a center of rotation, wherein the pivot body is located in the spacing, the pivot body moving the coupling element side-to-side in a linear manner along a longitudinal axis when the pivot body is rotated between first and second rotational positions so that the moveable terminals move in a common direction with respect to each other and along the longitudinal axis, the moveable terminals being electrically connected to the corresponding base terminals when the pivot body is in the first rotational position and disconnected from the corresponding base terminals when the pivot body is in the second rotational position.

2. The switching device in accordance with claim 1 wherein the moveable terminals extend substantially parallel to each other and have the spacing therebetween.

3. An electrical switching device comprising:

first and second circuit assemblies, each of the first and second circuit assemblies comprising a base terminal and a moveable terminal configured to flex to and from the base terminal, wherein a spacing exists between the first and second circuit assemblies;

a coupling element being operatively coupled to the moveable terminals of the first and second circuit assemblies, the coupling element extending lengthwise across the spacing between the first and second circuit assemblies; and an electromechanical motor including a pivot body operatively coupled to the coupling element and configured to rotate bi-directionally about a center of rotation, wherein the pivot body is located in the spacing and moves the coupling element side-to-side along a longitudinal axis so that the moveable terminals move in a common direction with respect to each other and along the longitudinal axis when the pivot body is rotated between first and second rotational positions, the moveable terminals being electrically connected to the corresponding base terminals when the pivot body is in the first rotational position and disconnected from the corresponding base terminals when the pivot body is in the second rotational position;

wherein the motor comprises an electromagnetic coil configured to generate predetermined magnetic fields, the pivot body being selectively rotated between the first and second rotational positions by the magnetic fields, the coil extending along a coil axis that is substantially parallel to the longitudinal axis.

4. The switching device in accordance with claim 1 wherein the motor comprises a pair of opposing yoke ends spaced apart from each other, the pivot body being located between the yokes ends, the yoke ends being magnetically coupled to the permanent magnet through the armatures.

5. The switching device in accordance with claim 1 wherein the pivot body further comprises a post projecting therefrom, the post being operatively coupled to and moving the coupling element along the longitudinal axis when the pivot body is rotated.

6. The switching device in accordance with claim 1 further comprising a housing, wherein the moveable and base terminals of the first and second circuit assemblies extend substantially parallel to one another within the housing.

7. The switching device in accordance with claim 1 wherein the moveable terminals comprise respective spring blades configured to electrically connect to the base terminals, the spring blades being operatively coupled to the coupling element and extending substantially parallel to one another, each of the spring blades moving away from the respective moveable terminal and toward the respective base terminal when the moveable and base terminals are electrically connected, each of the spring blades being biased in a common manner when the spring blades are electrically connected to the respective base terminals and moving in a common withdrawn direction when the pivot body is rotated.

8. The switching device in accordance with claim 7 wherein the spring blades include mating contacts configured to electrically connect to the corresponding base terminals and heat sinks in direct contact with the mating contacts, the heat sinks being configured to facilitate distributing heat generated by the current flowing through the spring blade and the mating contact.

9. The switching device in accordance with claim 7 wherein the spring blades include spring fingers being operatively coupled to the coupling element, the spring fingers providing a force against the coupling element to push the spring blade toward the base terminal.

10. An electrical switching device comprising:

first and second circuit assemblies, each of the first and second circuit assemblies comprising a base terminal and a moveable terminal configured to flex to and from the base terminal, the moveable terminals of the first and second circuit assemblies extending substantially parallel to one another and having a spacing therebetween;

a coupling element extending lengthwise across the spacing and being operatively coupled to the moveable terminals; and an electromechanical motor including a pivot body located within the spacing and that is operatively coupled to and located proximate to the coupling element, the pivot body rotating bi-directionally about a center of rotation between first and second rotational positions so that the coupling element moves side-to-side in a linear manner along a longitudinal axis within the spacing, the moveable terminals being electrically connected to the corresponding base terminals when the pivot body is in the first rotational position and disconnected from the corresponding base terminals when the pivot body is in the second rotational position.

11. The switching device in accordance with claim 10 wherein the moveable terminals move in a common direction with respect to each other and along the longitudinal axis when the pivot body is rotated between first and second rotational positions.

12. The switching device in accordance with claim 10 wherein the motor comprises an electromagnetic coil configured to generate predetermined magnetic fields, the pivot body being selectively rotated between the first and second rotational positions by the magnetic fields, the coil extending along a coil axis that is substantially parallel to the longitudinal axis.

13. The switching device in accordance with claim 10 further comprising a housing, wherein the moveable and base terminals of the first and second circuit assemblies extend substantially parallel to one another within the housing.

14. The switching device in accordance with claim 13 wherein the moveable and base terminals of the first and second circuit assemblies are received through a common side of the housing.

15. The switching device in accordance with claim 10 wherein the coupling element includes a pair of recesses, the pivot body being operatively coupled to the coupling element between the pair of recesses, wherein each of the first and second circuit assemblies have at least one of the corresponding base and moveable terminals extending through a corresponding one recess, the coupling element moving side-to-side along the longitudinal axis so that the at least one of the base and moveable terminals is moved within the corresponding recess.

16. The switching device in accordance with claim 1 wherein the pivot body comprises a projection that projects to a distal end, the distal end moving along an arc when the pivot body is rotated between the first and second rotational positions.

17. The switching device in accordance with claim 1 wherein the pivot body comprises a projection that projects away from an exterior surface of the pivot body to a distal end of the projection, the coupling element having an opening that is defined by opposing first and second surfaces and that receives the distal end, the distal end engaging the first surface in the first rotational position, the distal end moving away from the first surface and to the second surface when the pivot body moves toward the second rotational position.

18. The switching device in accordance with claim 1 wherein the pivot body comprises a projection that projects away from an exterior surface of the pivot body, the coupling element having an opening that receives the projection and that is sized and shaped to be greater than a cross-section of the projection to allow some movement within the opening without moving the coupling element.

19. An electrical switching device comprising:

first and second circuit assemblies, each of the first and second circuit assemblies comprising a base terminal and a moveable terminal configured to flex to and from the base terminal, wherein a spacing exists between the first and second circuit assemblies;

a coupling element being operatively coupled to the moveable terminals of the first and second circuit assemblies, the coupling element extending lengthwise across the spacing between the first and second circuit assemblies; and an electromechanical motor including a pivot body operatively coupled to the coupling element and configured to rotate bi-directionally about a center of rotation, wherein the pivot body is located in the spacing and moves the coupling element side-to-side along a longitudinal axis so that the moveable terminals move in a common direction with respect to each other and along the longitudinal axis when the pivot body is rotated between first and second rotational positions, the moveable terminals being electrically connected to the corresponding base terminals when the pivot body is in the first rotational position and disconnected from the corresponding base terminals when the pivot body is in the second rotational position;

wherein the coupling element has first and second recesses, the first recess receiving the base terminal from the first circuit assembly and the second recess receiving the moveable terminal from the second circuit assembly.

20. The switching device in accordance with claim 1 wherein the moveable terminals comprise respective spring blades configured to electrically connect to the base terminals, at least one of the spring blades including bifurcated paths with a blade spacing therebetween.

* * * * *